US007615123B2

(12) United States Patent
Kajinic et al.

(10) Patent No.: US 7,615,123 B2
(45) Date of Patent: Nov. 10, 2009

(54) COLD-WORK TOOL STEEL ARTICLE

(75) Inventors: Alojz Kajinic, Carnegie, PA (US); Andrzej L. Wojcieszynski, Pittsburgh, PA (US)

(73) Assignee: Crucible Materials Corporation, Syracuse, NY (US)

( * ) Notice: Subject to any disclaimer, the term of this patent is extended or adjusted under 35 U.S.C. 154(b) by 568 days.

(21) Appl. No.: 11/529,237

(22) Filed: Sep. 29, 2006

(65) Prior Publication Data

US 2008/0078475 A1 Apr. 3, 2008

(51) Int. Cl.
*C21D 5/00* (2006.01)

(52) U.S. Cl. ..... 148/321; 420/101; 420/102

(58) Field of Classification Search ..... 148/321; 420/102, 101

See application file for complete search history.

(56) References Cited

U.S. PATENT DOCUMENTS 5,458,703 A * 10/1995 Nakai ..... 148/503
5,651,842 A * 7/1997 Nakamura et al. ..... 148/321
6,837,945 B1 * 1/2005 Sandberg et al. ..... 148/333
2003/0156965 A1 * 8/2003 Ernst et al. ..... 420/12

FOREIGN PATENT DOCUMENTS

| | | | |
|---|---|---|---|
| EP | 0648852 | | 4/1995 |
| EP | 0875588 | | 4/1998 |
| EP | 0930374 | | 7/1999 |
| GB | 1443900 | * | 7/1976 |
| JP | 1-201442 | | 8/1989 |
| JP | 3-134136 | | 6/1991 |
| JP | 9-78199 | | 3/1997 |
| WO | WO 9302818 | | 2/1993 |
| WO | WO 0125499 | | 4/2001 |

* cited by examiner

*Primary Examiner*—Sikyin Ip
(74) *Attorney, Agent, or Firm*—Finnegan, Henderson, Farabow, Garrett & Dunner LLP

(57) ABSTRACT

A powder metallurgy cold-work tool steel article of hot isostatic compacted nitrogen atomized, prealloyed powder. The alloy of the article includes the addition of niobium, which combined with the use of gas atomization, results in a fine carbide size distribution. This in turn results in improved bend fracture strength and impact toughness. In addition, as a result of isostatic compaction of nitrogen gas atomized prealloyed powder a fine distribution of carbides results to obtain a microstructure that achieves both improved toughness and wear resistance.

5 Claims, 5 Drawing Sheets

Size distribution of primary carbides of the alloy of the invention and Alloy A, the PM benchmark alloy.

Etched microstructure of the alloy of the invention (LGA Heat L1984) hardened in oil from 1950°F and tempered at 1025°F for 2h+2h. The volume fraction of primary carbides is measured to be 3.5 vol. %. All the primary carbides in the alloy of the invention are of niobium-vanadium-rich MC type.

Etched microstructure of Alloy A (the CPM benchmark alloy) hardened in air from 1950°F and tempered at 975°F for 2h+2h. The volume fraction of primary carbides is measured to be 3.3 vol. %. All the primary carbides in Alloy A are of vanadium-rich MC type.

Etched microstructure of Alloy B (the conventionally ingot-cast benchmark alloy) hardened in air from 2050°F and tempered at 1025°F for 2h+2h+2h. The volume fraction of primary carbides is measured to be 3.8 vol. %. All the primary carbides in Alloy B are of vanadium-rich MC type.

Size distribution of primary carbides of the alloy of the invention and Alloy A, the PM benchmark alloy.

Size distribution of primary carbides of the alloy of the invention and Alloy A, the PM benchmark alloy, using the logarithmic scale for primary carbides count.

COLD-WORK TOOL STEEL ARTICLE

FIELD OF THE INVENTION

The invention relates to powder metallurgy cold-work tool steel article, manufactured by hot isostatic compaction of nitrogen atomized, prealloyed powder, with improved impact toughness. The new alloy was developed after discovering that the addition of niobium to tool steel results in a larger driving force for the precipitation of MC primary carbides, which combined with the gas atomization of the liquid alloy, results in a finer carbide size distribution. These finer carbides, in turn, result in improved bend fracture strength and impact toughness of the new tool steel. Hot isostatic compaction of nitrogen gas atomized prealloyed powder retains the fine distribution of carbides and makes it possible to obtain the microstructure necessary to achieve both the desired toughness and the wear resistance characteristics required for demanding cold-work applications.

BACKGROUND OF THE INVENTION

To provide for a satisfactory performance, cold-work tool steels must attain a required hardness, possess sufficient toughness and be resistant to wear.

The wear resistance of tool steels depends on the amount, the type, and the size distribution of primary carbides, as well as the overall hardness. Primary alloy carbides, due to their very high hardness, are the main contributors to wear resistance. Among all the types of primary carbides commonly found in tool steels the vanadium-rich MC primary carbides possess the highest hardness. Niobium also forms very hard Nb-rich MC carbides but its usage in tool steels produced by ingot metallurgy has been limited due to its tendency to form large MC carbides, which has detrimental effects on the toughness of Nb-containing tool steel.

To obtain the desired combination of toughness and resistance to wear in the cold-work tool steel of the invention, it is necessary to obtain a dispersion of very small MC primary carbides uniformly distributed in a matrix of tempered martensite.

Based on thermodynamic calculations (performed with Thermo-Calc software coupled with TCFE3 thermodynamic database) it was discovered that adding niobium to a cold work-tool steel composition (produced by powder metallurgy processing) results in a larger driving force for precipitation of MC type Nb-rich primary carbides, which in turn leads to a finer distribution of primary carbides. The following nominal chemical composition (in weight percent) of a new high-toughness cold-work tool steel grade has been formulated: Fe-0.8C-7.5Cr-0.75V-2.5Nb-1.3Mo-1.5W-0.1 N. The chemical composition of the matrix of the alloy of the invention and the volume fraction of MC primary carbides in the alloy of invention are similar to those characteristics of some other selected commercially produced cold work tool steels to provide desired hardening and wear resistance characteristics. PM metallurgy steel grade (referred to as Alloy A) and a conventional metallurgy tool steel grade (referred to as Alloy B), which compositions are listed in Table 1. Both steels (Alloy A and Alloy B) are used as the benchmark cold-work tool steels for comparison of toughness and strength properties, as well as the microstructural characteristics.

SUMMARY OF THE INVENTION

In accordance with the invention, there is provided a powder metallurgy cold-work tool steel article of hot isostatic compacted, nitrogen atomized, prealloyed powder having improved impact toughness. The prealloyed powder consists essentially of, in weight percent, carbon 0.5 to 1.2, nitrogen 0.02 to 0.20, silicon 0.3 to 1.3, manganese up to 1, chromium 6 to 9, molybdenum 0.6 to 2, tungsten 0.5 to 3.0, vanadium 0.2 to 2.0, niobium 1.0 to 4.0, and balance iron and incidental impurities.

Preferably, the alloy of the article has carbon of 0.75 to 0.85, nitrogen 0.08 to 0.14, silicon 0.5 to 1.1, manganese up to 0.5, chromium 7 to 8, molybdenum 1.0 to 1.5, tungsten 1.3 to 1.8, vanadium 0.5 to 1 and niobium 2.25 to 2.75.

The article of the invention has 2.5 to 6.0% volume % of spherical niobium-vanadium-rich MC primary carbides uniformly distributed in a matrix of tempered martensite.

The article of the invention has spherical niobium-vanadium-rich primary carbides, 95% of which are smaller than 1.25 microns in diameter when measured on metallographic cross section.

The article of the invention has spherical niobium-vanadium-rich primary carbides, 98% of which are smaller than 1.5 microns in diameter when measured on metallographic cross section.

It is to be understood that both the foregoing general description and the following detailed description are exemplary and explanatory only and are not restrictive of the invention, as claimed.

The accompanying drawings, which are incorporated in and constitute a part of this specification, illustrate two embodiments of the invention and together with the description, serve to explain the principles of the invention.

DESCRIPTION OF THE EMBODIMENTS

Chemical Compositions Tested

Figure 1:
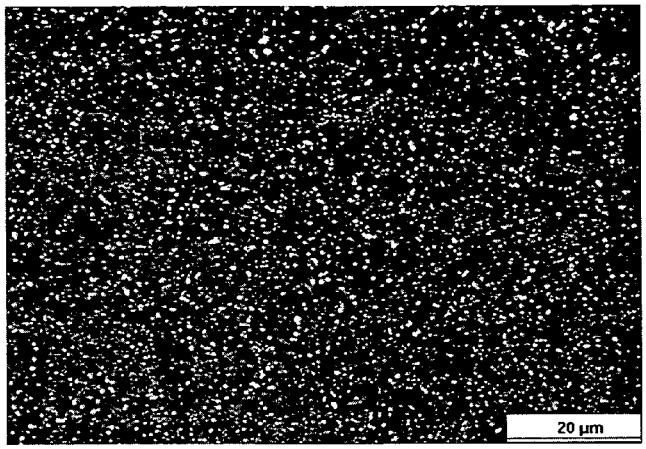
FIG. 1 is a photomicrograph of the etched microstructure (magnification of 500×) of the alloy of the invention hardened in oil from 1950° F. and tempered at 1025° F. for 2 hours+2 hours.

Table 1 discloses the chemical compositions that were examined experimentally and that led to the alloy of the invention that achieves an improved combination of toughness and wear resistance. The chemical compositions of Alloy A and Alloy B are included for comparison purposes.

Prealloyed cold-work tool steels of the reported chemical compositions, except for alloy B, were melted in a nitrogen atmosphere, atomized by nitrogen gas, and hot-isostatically-pressed (HIP).

The alloy of the invention is designed to have approximately the equivalent matrix chemical compositions and the volume fractions of MC primary carbides as Alloy A. The key improvement over Alloy A in terms of toughness characteristics is due to the discovery that the size distribution of the Nb-rich MC primary carbides in the alloy of the invention is shifted toward smaller primary carbides compared to the size distribution of the V-rich MC primary carbides in Alloy A (FIGS. 1, 2, 4, and 5). The improvement is even more pronounced when the alloy of the invention is compared with Alloy B, the conventionally ingot-cast alloy (FIG. 3).

Approximately 50 lbs of the alloy of the invention (Alloy LGA) was melted and atomized on the Laboratory Gas Atomizer (LGA) having a capacity of 50 lbs., and about 650 lbs of the alloy of the invention (Alloy PGA) was melted and atomized on the Pilot Gas Atomizer (PGA), having a capacity of 800 lbs., at Crucible Research. The chemical analyses of the two heats are given in Table 1.

With respect to the various alloying elements in the alloy of the invention, the following applies:

Carbon is present in an amount of at least 0.5%, while the maximum content of carbon may amount to 1.2%, and preferably in the range of 0.75-0.85%. It is important to carefully control the amount of carbon in order to obtain a desired combination of toughness and wear resistance, as well as to avoid forming unduly large amounts of retained austenite during heat treatment.

Nitrogen is present in an amount of 0.02-0.20%, and preferably in the range of 0.08-0.14%. The effects of nitrogen in the alloy of the invention are rather similar to those of carbon. In tool steels, where carbon is always present, nitrogen forms carbonitrides with vanadium, niobium, tungsten, and molybdenum.

Silicon may be present in an amount of 0.3-1.3%, and preferably in the range of 0.5-1.1%. Silicon functions to deoxidize the prealloyed materials during the melting phase of the gas-atomization process. In addition, silicon improves the tempering response. Excessive amounts of silicon are undesirable, however, as it decreases toughness and promotes the formation of ferrite in the microstructure.

Manganese may be present in an amount of up to 1%, and preferably up to 0.5%. Manganese functions to control the negative effects of sulfur on hot workability. This is achieved through the precipitation of manganese sulfides. In addition, manganese improves hardenability and increases the solubility of nitrogen in the liquid prealloyed materials during the melting phase of the gas-atomization process. Excessive amounts of manganese are undesirable, however, as it can lead to the formation of unduly large amounts of retained austenite during the heat treatment.

Chromium is present in an amount of 6.0-9.0%, and preferably in the range of 7.0-8.0%. The main purpose of chromium in cold-work tool steels is to increase hardenability and secondary-hardening response.

Molybdenum is present in an amount of 0.6-2.0%, and preferably in the range of 1.0-1.5%. Like chromium, molybdenum increases hardenability and secondary-hardening response of the alloy of the invention. Excessive amounts of molybdenum, however, reduce hot workability.

Tungsten is present in an amount of 0.5-3.0%, and preferably in the range of 1.3-1.8%. Like chromium and molybdenum, tungsten increases hardenability and secondary-hardening response of the alloy of the invention. In cold-work tool steels, tungsten behaves in a similar manner as molybdenum, with which it is interchangeable on an atomic basis; approximately 1.9 wt. % W has the same effect as 1 wt. % Mo.

Vanadium is present in an amount of 0.2-2.0%, and preferably in the range of 0.5-1.0%. Vanadium is critically important for increasing wear resistance. This is achieved through the precipitation of MC type primary carbonitrides.

Niobium is present in an amount of 1.5-4.0%, and preferably in the range of 2.25-2.75%. Every percent of niobium is equivalent to the amount of vanadium calculated as follows:

$$\% V=(50.9/92.9)\times\% Nb$$

where 50.9 and 92.9 are atomic weights of vanadium and niobium, respectively. In cold-work tool steels, niobium and vanadium are equivalent elements with respect to wear resistance.

TABLE 1

Chemical compositions of the two heats of the alloy of the invention that were melted and atomized at Crucible Research, and Alloys A and B.

| Alloy | C | Cr | V | Nb | Mo | W | Mn | Si | P | S | O | N |
|---|---|---|---|---|---|---|---|---|---|---|---|---|
| LGA | .76 | 7.50 | .74 | 2.48 | 1.30 | 1.43 | .40 | .95 | .007 | .005 | .009 | .12 |
| PGA | .76 | 7.33 | .73 | 2.50 | 1.19 | 1.48 | .42 | .98 | .009 | .005 | .015 | .11 |
| A | .84 | 7.49 | 2.61 | — | 1.37 | — | — | — | — | 0.02 | — | — |
| B | 1.11 | 7.48 | 2.69 | — | 1.69 | 1.14 | — | — | — | — | — | — |

TABLE 2

Heat-treatment response of the alloy of the invention (LGA), and Alloys A and B.

| | | Tempering Temperature [° F.] | | | | | | |
|---|---|---|---|---|---|---|---|---|
| Alloy | Austen. | 950 | 1000 | 1025 | 1050 | 1100 | 1150 | 1200 |
| LGA | 1950° F. | 61.9 | 61.2 | 59.0 | 55.7 | 49.5 | 46.2 | 41.4 |
| A | | 61.0 | 59.0 | 57.0 | 54.0 | — | — | — |
| B | | 63.0 | 61.0 | 59.0 | 56.0 | — | — | — |
| LGA | 2050° F. | 62.5 | 62.0 | 60.5 | 58.0 | 50.7 | 46.6 | 43.1 |
| A | | 63.0 | 61.0 | 60.0 | 57.0 | — | — | — |

TABLE 3

Bend fracture strength of the alloy of invention (LGA and PGA alloys), and Alloys A and B.

| | Aust. | | Bend Fracture Strength [ksi] | | | |
|---|---|---|---|---|---|---|
| Alloy | Temp. | HRC | Longit. | σ | Transv. | σ |
| LGA | 1950° F. | 59.0 | 758.7 | 11.6 | 691.0 | 55.0 |
| | 2050° F. | 60.5 | 798.6 | 9.3 | 762.0 | 49.1 |
| PGA | 1950° F. | 58.0 | 708.3 | 7.6 | 696.1 | 22.2 |
| | 2050° F. | 59.0 | 748.0 | 8.5 | 717.9 | 37.8 |
| A | 1950° F. | 60.0 | 742.8 | 17.2 | 540.7 | 27.3 |
| B | 1950° F. | 60.0 | 658.1 | 33.9 | 313.6 | 41.5 |
| | 2050° F. | 60.5 | 644.1 | 11.4 | 290.1 | 95.5 |

TABLE 4

Charpy C-notch impact toughness of the alloy of invention (LGA and PGA alloys), and Alloys A and B.

| Alloy | Aust. Temp. | HRC | Bend Fracture Strength [ksi] Longit. | σ | Transv. | σ |
|---|---|---|---|---|---|---|
| LGA | 1950° F. | 59.0 | 53.1 | 13.4 | 56.3 | 20.2 |
| | 2050° F. | 60.5 | 59.4 | 17.5 | 33.8 | 6.2 |
| PGA | 1950° F. | 58.0 | 71.1 | 8.7 | 57.7 | 10.3 |
| | 2050° F. | 59.0 | 77.5 | 12.3 | 54.5 | 4.8 |
| A | 1950° F. | 60.0 | 69.5 | 3.3 | 17.3 | 1.7 |
| B | 1950° F. | 60.0 | 23.7 | 1.8 | 3.2 | 0.3 |
| | 2050° F. | 60.5 | 15.3 | 1.8 | 4.0 | 1.0 |

TABLE 5

Pin abrasion wear resistance of the alloy of invention (LGA and PGA alloys), and Alloys A and B.

| Alloy | Austenit. Temp. | Tempering Temp. | HRC | Pin-abrasion wear resistance [milligram] |
|---|---|---|---|---|
| LGA | 1950° F. | 1025° F. | 59.0 | 57.5 |
| | 2050° F. | | 60.5 | 55.5 |
| PGA | 1950° F. | | 58.0 | 58.0 |
| | 2050° F. | | 59.0 | 55.5 |
| A | 1950° F. | 1025° F. | 60.0 | 59.5 |
| B | 2050° F. | 1000° F. | 62.5 | 42.0 |

LGA Heat and PGA Heat

Powder of the alloy of invention produced on Laboratory Gas Atomizer (Alloy LGA) and on Pilot Gas Atomizer (Alloy PGA) was containerized into 4.5-5" OD containers and was hot isostatically pressed (HIP), and then forged into a 3"×1" bar, Alloy LGA, or a 3"×1.25" bar, Alloy PGA.

The heat-treatment response of Alloy LGA (the alloy of the invention) is given in Table 2. The following two austenitization temperatures were selected: 1950° F. and 2050° F. The results are comparable to those of the Alloys A and B.

The longitudinal and transverse bend fracture strength (BFS) and Charpy C-notch (CCN) impact toughness of the 3"×1" and 3"×1.25" forged bars of the alloy of the invention were also evaluated. The following two austenitization temperatures were selected: 1950° F. and 2050° F. The CCN and BFS specimens were tempered at 1025° F. for 2 hours+2 hours.

A 6.35 mm×6.35 mm×55 mm specimen, supported by two cylinders, is used in the three-point BFS test. The distance between the supporting cylinders is 25.4 mm. The third cylinder is used to apply a load until the BFS specimen fractures, the applied load being equidistant from the either supportive cylinders. The load at which the BFS specimen breaks is used to calculate the numerical value of bend fracture strength.

The geometry of a specimen used to measure Charpy C-notch impact toughness is similar to that used to measure Charpy V-notch impact toughness: 10 mm×10 mm×55 mm. The radius and the depth of the C-notch are 25.4 mm and 2 mm, respectively.

The BFS and CCN results obtained from Alloy LGA and Alloy PGA, and Alloys A and B are given in Table 3 and Table 4, respectively. The alloy of the invention demonstrated superior toughness characteristics compared to the benchmark alloys, as measured with bend fracture strength and Charpy C-notch impact toughness.

Finally, four heat-treated pin-abrasion wear-resistance specimens were tested from the alloy of the invention. Two specimens were machined from the Alloy LGA and two specimens were machined from the Alloy PGA. The austenitization temperatures of 1950° F. and 2050° F. were selected. After quenching in oil, all the specimens were tempered at 1025° F. for 2 hours+2 hours. The pin-abrasion wear resistance test results are given in Table 5. The pin abrasion test results for Alloy A and Alloy B are included for comparison.

Microstructure

FIG. 1 shows the etched microstructure of the alloy of the invention hardened in oil from 1950° F. and tempered at 1025° F. for 2 hours+2 hours. The microstructure of the alloy of the invention consists of approximately 3.5 vol. % of very fine, spherical Nb—V-rich MC primary carbides uniformly distributed in the matrix of tempered martensite.

Figure 2:
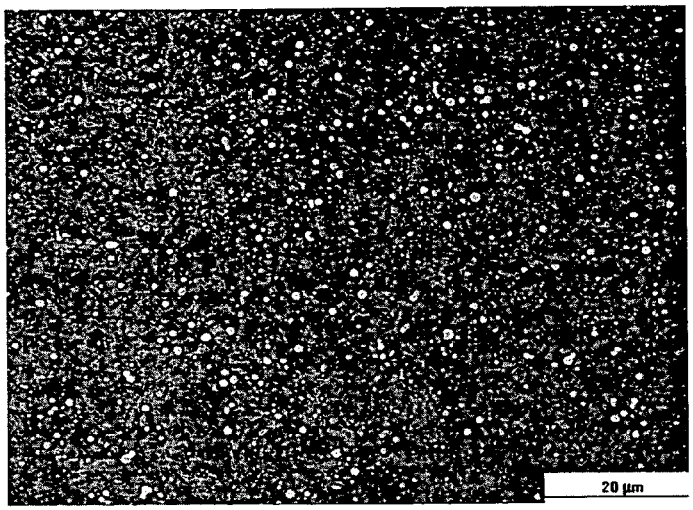
FIG. 2 is a photomicrograph of the etched microstructure (magnification of 500×) of Alloy A, hardened in air from 1950° F. and tempered at 975° F. for 2 hours+2 hours.
Figure 3:
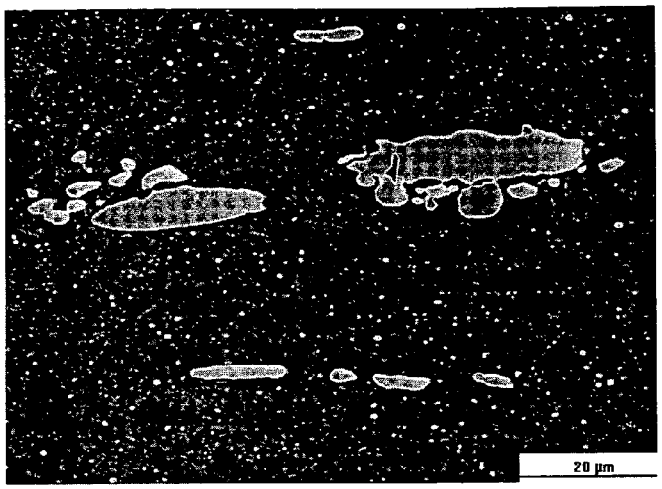
FIG. 3 is a photomicrograph of the etched microstructure (magnification of 500×) of Alloy B, a conventionally ingot-cast alloy, hardened in air from 2050° F. and tempered at 1025° F. for 2 hours+2 hours+2 hours.

FIG. 2 shows the etched microstructure of Alloy A, the PM benchmark alloy, hardened in air from 1950° F. and tempered at 975° F. for 2 hours+2 hours. The microstructure of Alloy A consists of approximately 3.3 vol. % of fine, spherical V-rich MC primary carbides uniformly distributed in the matrix of tempered martensite.

FIG. 3 shows the etched microstructure of Alloy B, the conventionally ingot-cast benchmark alloy, hardened in air from 2050° F. and tempered at 1025° F. for 2 hours+2 hours+2 hours. The microstructure of Alloy B consists of approximately 3.8 vol. % of coarse V-rich MC primary carbides non-uniformly distributed in the matrix of tempered martensite.

The size distribution of primary carbides in the alloy of invention and Alloy A was measured using an automatic image analyzer. The diameter of carbides was measured in fifty random fields examined at an optical magnification of 1000×. The count of primary carbides (per square millimeter) of various sizes in the alloy of the invention and Alloy A is plotted in FIG. 4. The count of primary carbides (per square millimeter) of various sizes in the alloy of the invention and Alloy A is plotted in FIG. 5, but this time using the logarithmic scale for the primary carbides count to show more clearly the difference between the alloy of the invention and Alloy A when it comes to the primary carbides larger than 1 μm.

Figure 4:
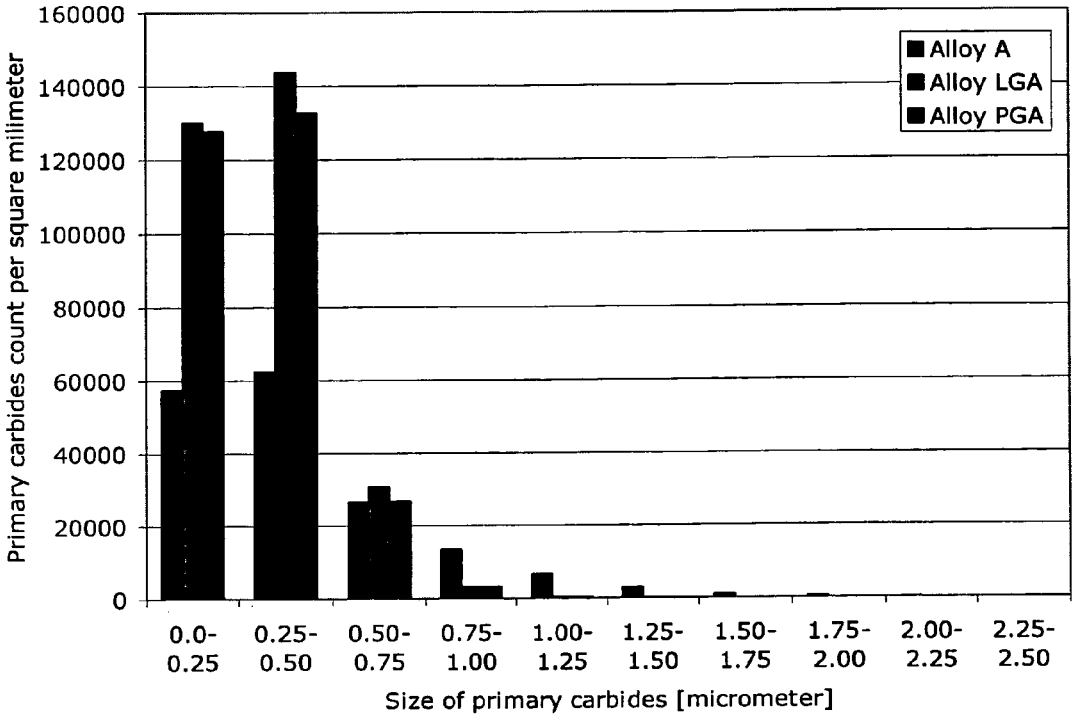
FIG. 4 is a bar graph showing the size distribution of primary carbides of the alloy of the invention and Alloy A.
Figure 5:
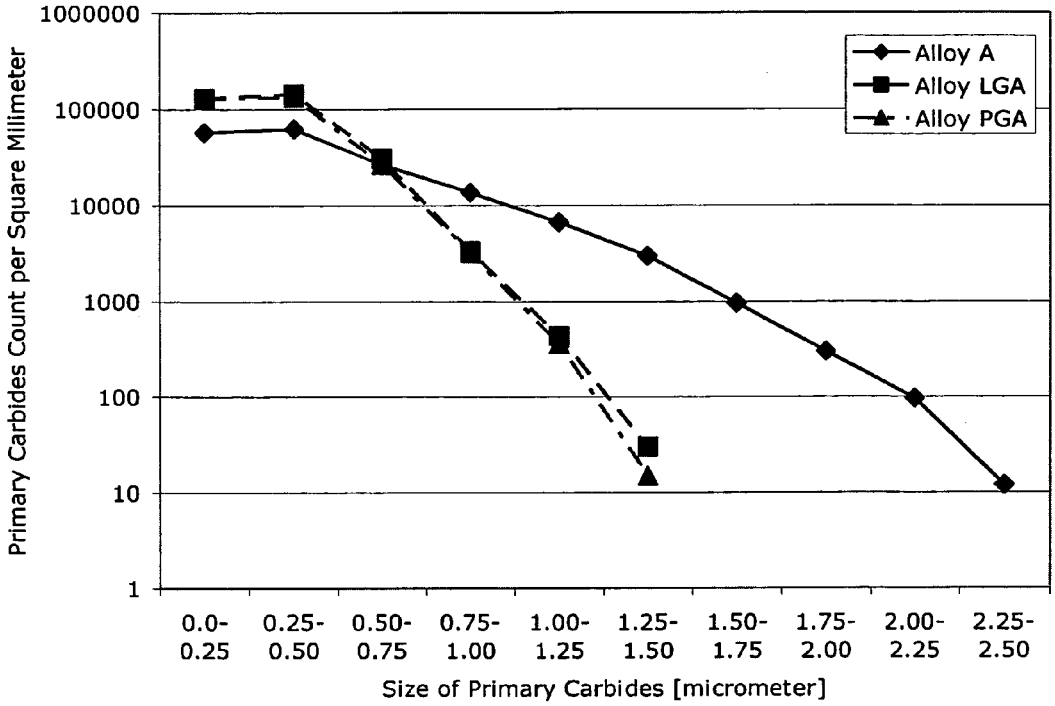
FIG. 5 is a graph showing the size distribution of primary carbides of the alloy of the invention and Alloy A, using the logarithmic scale for the primary carbides count.

The graph in FIG. 4 shows that the alloy of invention contains a larger number of carbides smaller than 0.5 μm, while Alloy A contains larger number of carbides with carbide diameter 0.5-2.5 μm. FIG. 5 also shows that the maximum size of carbides in the alloy of invention is less than 1.5 μm and the maximum carbide size in Alloy A is about 2.5 μm. For any given size there is a larger percentage of carbides smaller than the given value in the alloy of the invention than in Alloy A. Because the matrix composition of the alloy of the invention is similar to the matrix composition of the alloy of prior art, which results in a similar attainable hardness, the finer carbide size distribution in the alloy of the invention is the main reason for the improved toughness of this alloy.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A powder metallurgy cold-work tool steel article of hot isostatic compacted, nitrogen atomized, prealloyed powder having improved impact toughness, said prealloyed powder consisting essentially of, in weight percent, carbon 0.5 to 1.2, nitrogen 0.02 to 0.20, silicon 0.3 to 1.3, manganese up to 1, chromium 6 to 9, molybdenum 0.6 to 2, tungsten 0.5 to 3.0, vanadium 0.2 to 2.0, niobium 1.0 to 4.0, and balance iron and incidental elements and impurities.

2. The article of claim 1, wherein carbon is 0.75 to 0.85, nitrogen is 0.08 to 0.14, silicon is 0.5 to 1.1, manganese is up to 0.5, chromium is 7 to 8, molybdenum is 1.0 to 1.5, tungsten is 1.3 to 1.8, vanadium is 0.5 to 1 and niobium is 2.25 to 2.75.

3. The article of claim 1 or claim 2, comprising 2.5% to 6.0% volume percent of spherical niobium-vanadium-rich MC primary carbides uniformly distributed in a matrix of tempered martensite.

4. The article of claim 1 or claim 2 or claim 3 having spherical niobium-vanadium-rich primary carbides, 95% of which are smaller than 1.25 μm in diameter when measured on metallographic cross section.

5. The article of claim 1 or claim 2 or claim 3 having spherical niobium-vanadium-rich primary carbides, 98% of which are smaller than 1.5 μm in diameter when measured on metallographic cross section.

* * * * *